US005596998A

United States Patent [19]

Yasuda

[11] Patent Number: 5,596,998

[45] Date of Patent: Jan. 28, 1997

[54] HAIR CLIP

[75] Inventor: Masahiro Yasuda, Osaka, Japan

[73] Assignee: Kabushiki Kaisha Yasuda Corporation, Osaka, Japan

[21] Appl. No.: 512,639

[22] Filed: Aug. 8, 1995

[51] Int. Cl.[6] ..... A45D 8/12

[52] U.S. Cl. ..... 132/275; 132/279; 132/276; 132/277; 132/278

[58] Field of Search ..... 132/275, 276, 132/277, 278, 279; D28/39, 40, 41, 42, 43

[56] References Cited

U.S. PATENT DOCUMENTS 4,991,607 2/1991 Chen .

FOREIGN PATENT DOCUMENTS 796519 6/1958 United Kingdom .
1373518 11/1974 United Kingdom .
2215390 9/1989 United Kingdom .
2270257 3/1994 United Kingdom .

*Primary Examiner*—Gene Mancene
*Assistant Examiner*—Pedro Philogene
*Attorney, Agent, or Firm*—Armstrong, Westerman, Hattori, McLeland & Naughton

[57] ABSTRACT

A hair clip includes a base plate having at one end portion a pair of hooking arms, and a hair retainer having one end portion rotatably connected to the other end portion of said base plate. The hair retainer further has at the other end portion thereof an engaging part releasably latched by the pair of hooking arms. A spring board has one end portion connected to one end of said hair retainer and the other end portion of which is a free end. The spring board is positioned between the base plate and the hair retainer and curved in the opposite direction to the curve of the hair retainer.

8 Claims, 6 Drawing Sheets

HAIR CLIP

FIELD OF THE INVENTION

The present invention relates to a hair clip and more particularly to an ornamental hair clip for retaining hairs by and between two metal sheets via a spring force.

BACKGROUND OF THE INVENTION

There are many kinds of hair clips known in the art, and disclosed, for example, in Japanese Utility Model Publication (unexamined) Nos.45-3321, 50-47698, 50-154195, 57-55403 and 61-174504. Those prior hair clips generally comprise a base plate fixed to an ornamental cover, a downwardly curved and band-shaped spring board whose both ends are slidably fixed to the base plate, and a band-shaped retainer operably disposed beneath the spring board. The retainer has a fixed end pivoted to a pair of brackets protruding from one end of the base plate, and also has a movable end formed with an engaging part which is releasably latched to a pair of hooks provided at the other end of the base plate.

These prior art hair clips retain hairs by and between the spring board and the retainer, with the engaging part thereof being held in place by the hooks.

However, these prior hair clips cannot be desirably used to retain a large mass of hairs, such as bunched hairs, because the hair clips are designed to retain hairs by and between the downwardly curved spring board and the retainer.

To retain a large mass of hairs between the downwardly curved spring board and the retainer, a space formed between the spring board and the retainer should be large enough to insert a large mass of hairs.

However, due to the downwardly curved spring board, the retainer needs to be rotated a large extent towards its open position to enlarge the space. Therefore, such a hair inserting operation is somewhat troublesome.

In addition, when a large mass of hairs is retained in the space with the engaging part held in place by the hooks, the downwardly curved spring board needs to be depressed according to the thickness of the hairs against the resilient force of the spring board. In this case, a larger pressure is required to depress the spring board, and the durability of the hair clip is declined because the spring board is subjected to excessive forces in the retained state.

SUMMARY OF THE INVENTION

An object of the present invention which was made to resolve the aforementioned problems is therefore to provide a hair clip which easily retains hairs despite the amount of hairs retained.

According to the present invention, a hair clip comprises:

a base plate having at one end portion a pair of hooking arms;

a hair retainer having one end portion rotatably connected to the other end portion of the base plate;

the hair retainer further having at the other end portion thereof an engaging part releasably latched by the pair of hooking arms;

a spring board having one end portion connected to one end of the hair retainer and the other end portion being a free end;

the spring board being positioned between the base plate and the hair retainer and curved in the opposite direction to the curve of the hair retainer.

A large mass of hairs, such as bunched hairs, is inserted in a relatively large space formed between the base plate and the spring board and is retained by and between the base plate and the spring board.

On the other hand, a small amount of hairs is inserted in a relatively small space formed between the spring board and the hair retainer.

The spring board is preferably made by longitudinally punching an intermediate portion in the crosswise direction of the hair retainer except for areas at both end portions thereof so as to protrude from one end portion of the hair retainer.

The spring board preferably has one end portion protruding from one end portion of the hair retainer towards the base plate, a middle portion protruding from an end of one end portion, and is curved in the opposite direction to a curve of the hair retainer.

DETAILED DESCRIPTION OF THE PREFERRED EMBODIMENT

Preferred embodiments of a hair clip according to the present invention will now be described in detail, with reference to the accompanying drawings.

Figure 1:
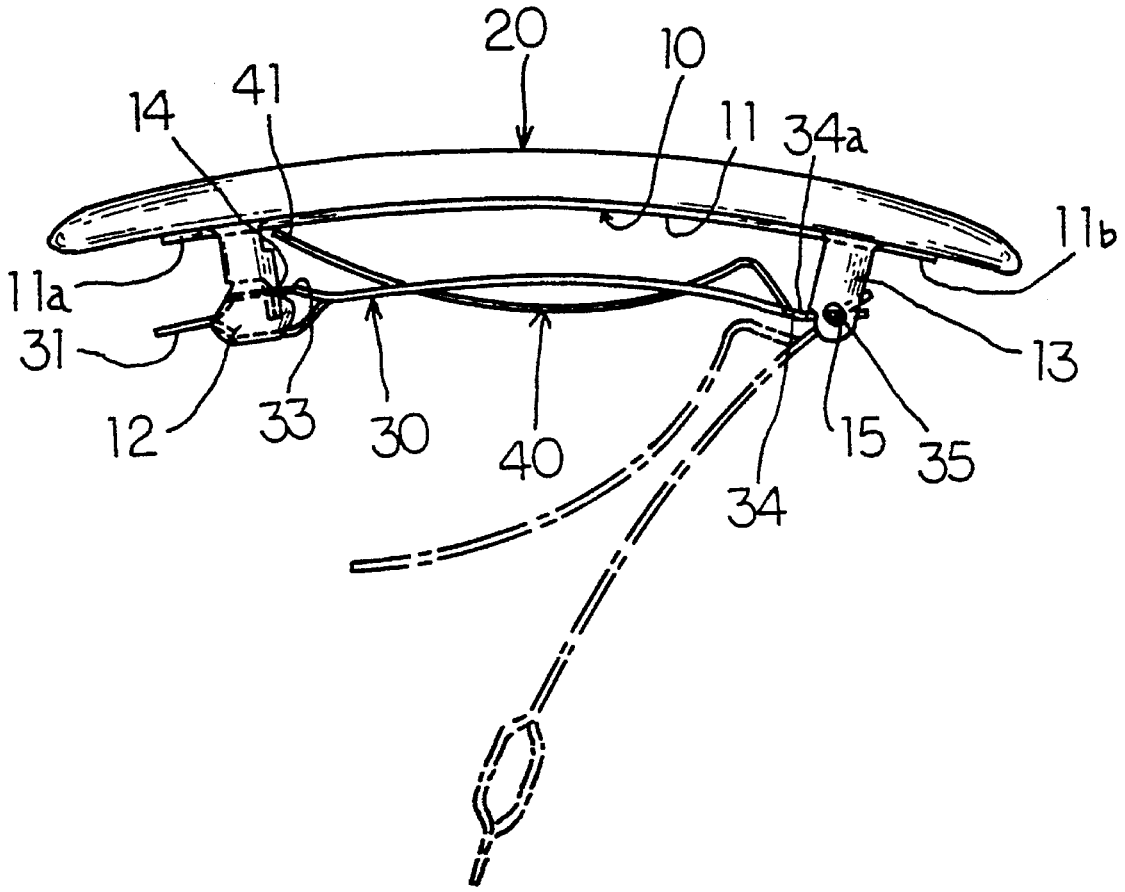
FIG. 1 shows a front elevation of a hair clip in closed state according to the present invention.

The words "up" or the like in FIG. 1 are used herein for convenient description of the portions nearer the top edge of the paper, and the words "down" or the like mean the portions nearer the bottom edge.

A hair clip in a preferred embodiment comprises a base plate 10, an ornamental cover 20, a hair retainer 30 and a spring board 40.

The base plate 10 for securing the ornamental cover 20 is made of a metal sheet.

Figure 2:
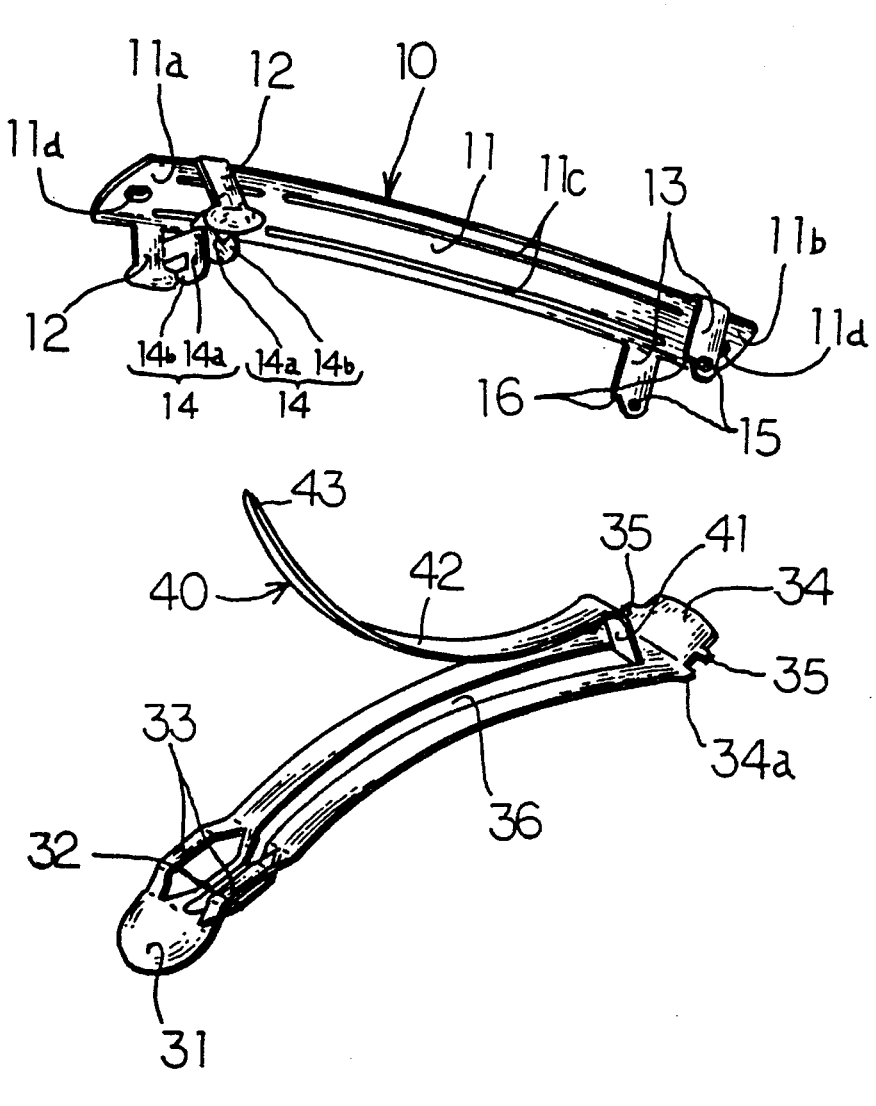
FIG. 2 shows a perspective view of a base plate, a hair retainer having a spring board in a disassembled state, which constitutes the hair clip.

As shown in FIG. 2, base plate 10 is composed of a band-shaped sheet portion 11 which is slightly curved upward, a pair of ledges 12 facing one another and downwardly protruding from opposite sides of the sheeted portion at one end 11*a* thereof, and a pair of ledges 12 facing one another and also downwardly protruding from opposite sides of the sheet portion 11 at the other end 11*b* thereof.

The distance between the ledges 12 is slightly expanded towards their lower ends. An L-shaped hooking arm 14 protrudes inwardly from the inner edge of each ledge 12 so as to face the widthwise center of the base plate 10. Each of the hooking arms 14 has a vertical leg 14*a*, and these legs always overlap with one another at least partially, though the hooking arms 14 are usually caused by the inclination of the ledges 12 to open towards their lower ends. The lower ends of the arms 14 are rounded, with their outer edges being shaped to serve as hooks 14*b*.

A pivot receiving aperture 15 is formed through a lower portion of each bracket 13, which portion has also a shoulder 16 formed to face the lengthwise center of the base plate 10

The band-shaped sheet portion 11 is reinforced with longitudinal ridges 11*c* which protrude downwardly to extend along opposite sides of said portion.

The ornamental cover 20 is a molded plastics article of a given shape, and is fixed to the upper surface of the base plate 10, by using punched holes 11*d* located at longitudinal end regions thereof. The ornamental cover 20 can be replaced by another article, which can be made of various kinds of materials, and can be of a different shape, size, etc. Alternatively, the base plate itself can be used as an ornamental cover.

The hair retainer 30 is a band-shaped steel spring, and its middle region intermediate the longitudinal ends is slightly curved upwards.

As shown in FIG. 2, the hair retainer 30 has a left-hand end portion 31 formed with two parallel slits extending longitudinally of the retainer. A middle portion between the slits is a downwardly dented part 32, which is interposed between two parallel and outer arched bridges 33, which in turn are curved upwards to serve as an engaging part. A right-hand end portion 34 of the hair retainer 30 is bent upwards and outwards, and small pivots 35 protrude from the lateral sides of the right-hand end portion 34. A slot 36, which extends longitudinally of the hair retainer 40, penetrates the intermediate region in the crosswise direction of the hair retainer 30.

The right-hand end portion 34 of the retainer 30 is positioned between the brackets 13, as shown in FIG. 1. The pivots 35 at the end portion 34 are respectively inserted in the apertures 15 so that the hair retainer 30 thus mounted on the base plate 10 is rotatable relative to it. Such a hinged connection permits the hair retainer 30 to freely swing towards its closed position, until the shoulders 16 of the brackets 13 will collide with stopping lugs 34*a* protruding sideways from the opposite sides of the right-hand end portion 34. Thus, an interim stable state occurs in which a given distance is kept between the engaging part 33 and the hooking arms 14 of the base plate 10. However, the hair retainer 30 cannot easily swing any further out of this interim state.

As with to the base plate 10 and the hair retainer 30, the spring board 40 is a band-shaped steel member.

As shown in FIG. 2, the spring board 40 protrudes from the right-hand end portion 34 of the hair retainer 30 and is positioned between the base plate 10 and the hair retainer 30. The spring board 40 has a right-hand end portion 41 protruding upwards from the right-hand end of the slot 36, a middle portion 42 protruding from an upper end of the right-hand end portion 41 and curved downwards, in other words, curved in the opposite direction to the curve of the hair retainer 30, and a left-hand end portion 43 which is an end of the middle portion 42.

In a preferred embodiment, the spring board 40 is made by longitudinally punching an intermediate portion in the crosswise direction of the hair retainer 30, except for areas at both the right-hand and left-hand end portions 31 and 34. Since the spring board 40 is made by punching the hair retainer 30, both the hair retainer 30 and the spring board 40 form one body. Thus, the punching process makes it possible to reduce die making costs, punching and assembling steps. Further, since the punched portion of the hair retainer 30 will be used as the spring board 40, the material such as metal sheet which will be made into the hair retainer 30 and/or the spring board 40, can be reduced, therefore reduction of the cost will be achieved. Further, the punched portion of the hair retainer 30 will make the hair clip, as a whole, lightweight. Thus, the spring board 40 is desirably made by punching the hair retainer 30. However, the hair retainer 30 and the spring board 40 can be made separately, and then connected by welding or the like.

When the hair retainer 30 is swung towards its closed position, the free end portion 43 of the spring board 40 will come into contact with the base plate 10 before the engaging parts 33 of the hair retainer 30 come into contact with the hooking arms 14 of the base plate 10. Thus, the spring board 40 will urge the hair retainer 30 towards its open position when the engaging parts 33 are latched by the hooks 14. In this latched state, if the ledges 12 are gripped and pushed with one's fingers towards each other in order to cause the vertical legs 14*a* of the hooking arms 14 to overlap each other, to thereby disengaging the hooks 14*b* from the arched bridges 33 as the engaging part, the hair retainer 30 will rotate toward its open position by the resilient force of the spring board 40. The spring board 40 will not only urge the hair retainer 30 towards its open position as described above, but will also assist to retain the hair retainer 30.

Depending on the volume of the hairs retained by the hair clip, a space A formed between the base plate 10 and the spring board 40 or a space B formed between the spring board 40 and the hair retainer 30 is selectively used.

Figure 3:
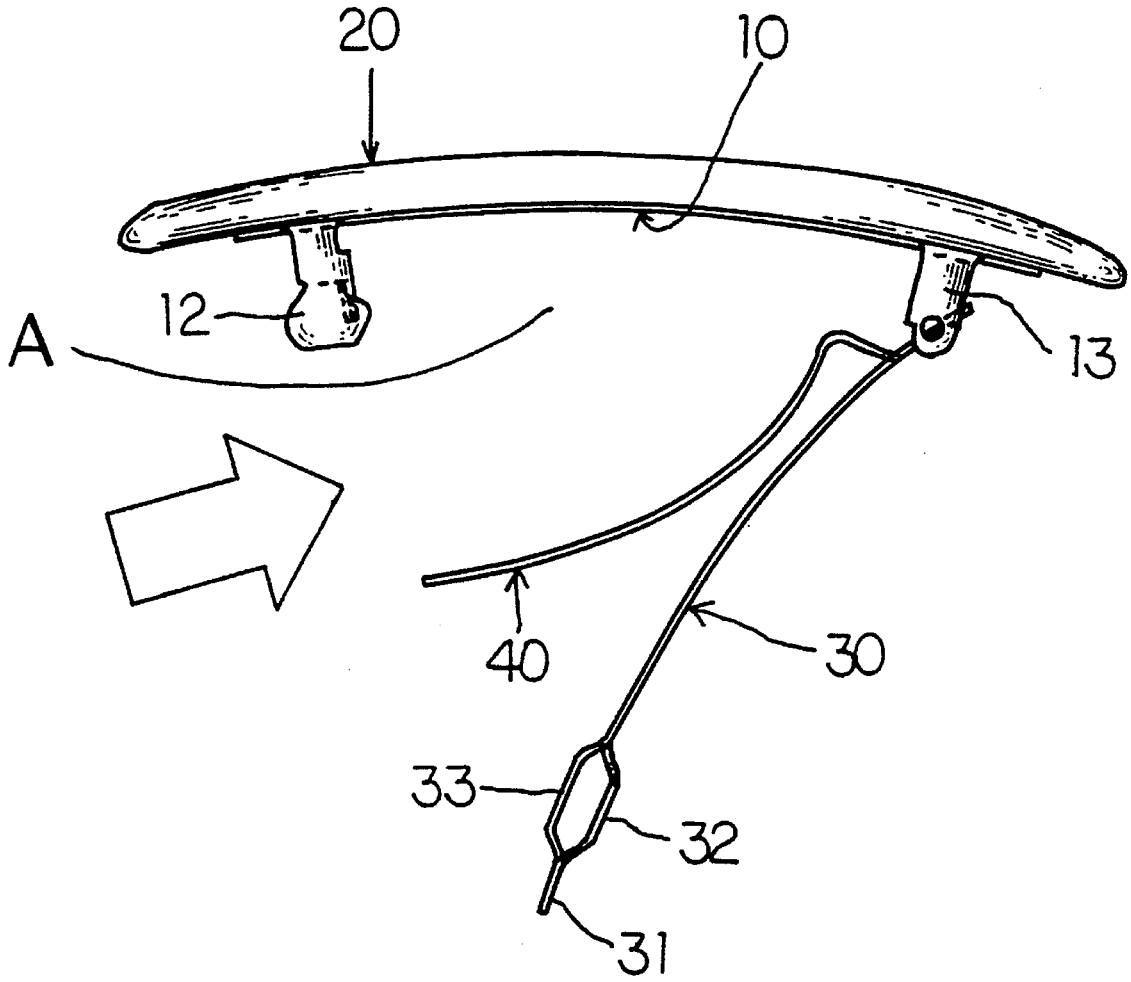
FIG. 3 shows a front elevation of the hair clip in an open state for inserting a large mass of hairs such as bunched hairs.
Figure 4:
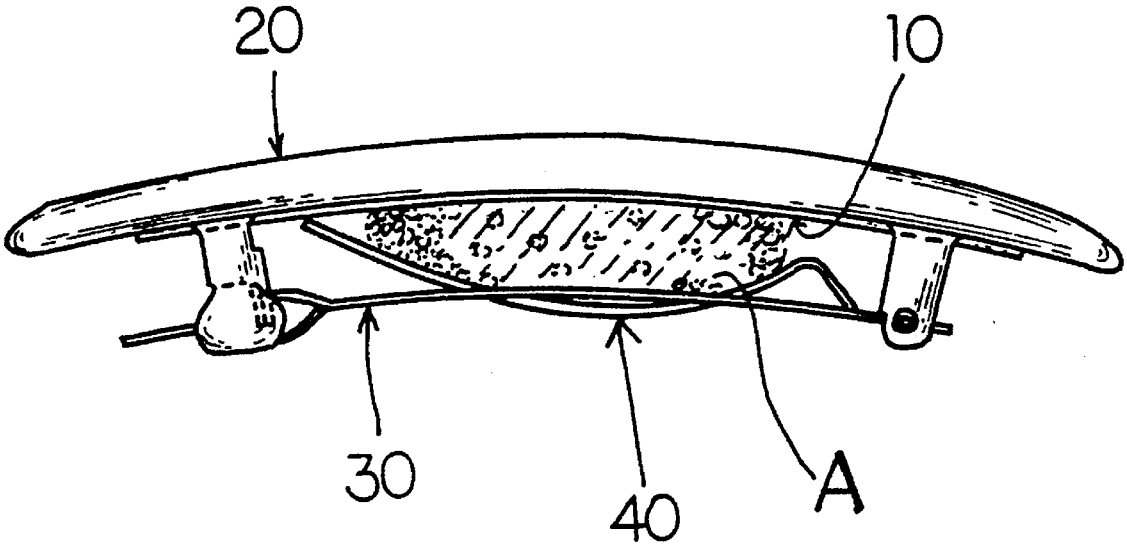
FIG. 4 shows a front elevation of the hair clip which retains a large mass of hairs such as bunched hairs.

When a large mass of hairs, such as bunched hairs, is retained by the hair clip, the hairs should be inserted into the space A formed between the base plate 10 and the spring board 40 as shown in FIG. 3. Then, the hair retainer 30 is rotated towards its closed position. In this state as shown in FIG. 4, such a large mass of hairs will be retained in the relatively large space A formed between the base plate 10 and the spring board 40 without any difficulty. Thus, a large force will not be required to retain the hairs. Accordingly, in the retained state, the spring board 40 will not be subjected to excessive forces. Therefore, durability of the hair clip will be enhanced.

Figure 5:
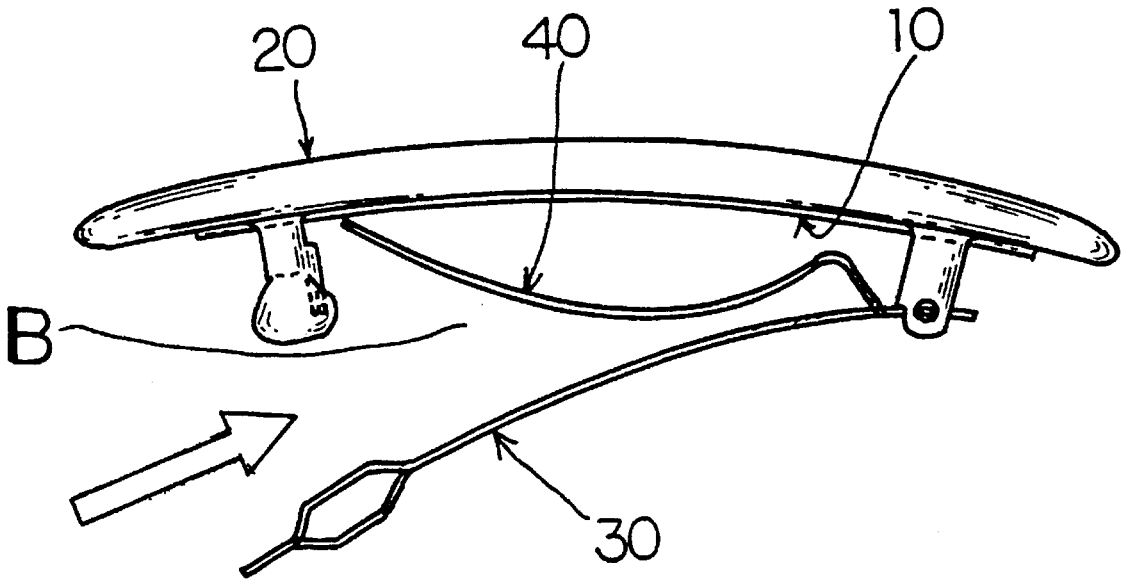
FIG. 5 shows a front elevation of the hair clip in open state for inserting small amount of hairs.
Figure 6:
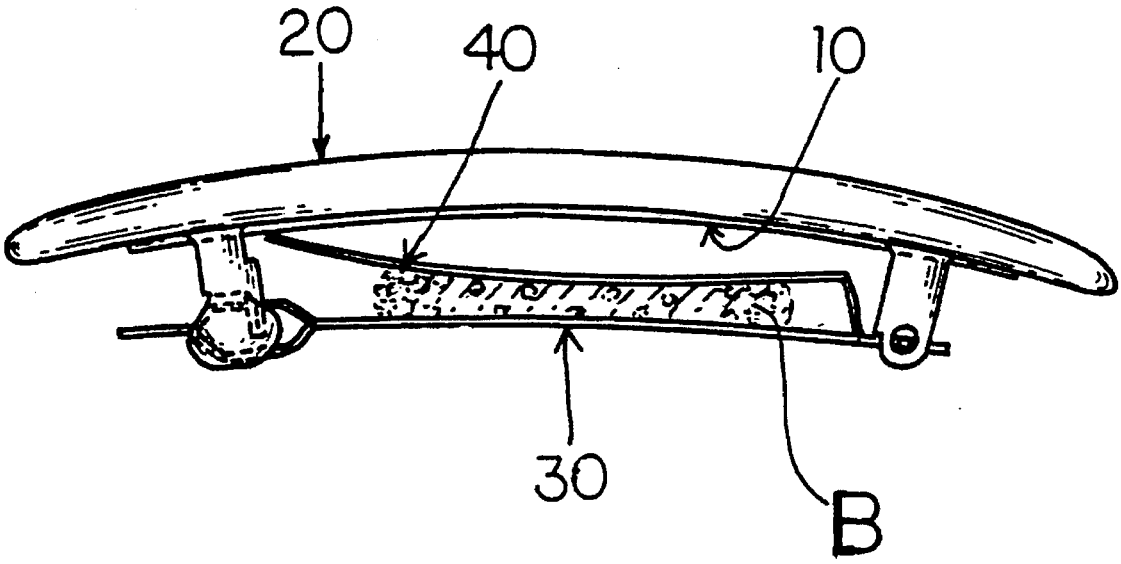
FIG. 6 shows a front elevation of the hair clip which retains small amount of hairs.

On the other hand, when a relatively small amount of hairs is retained by the hair clip, the hairs should be inserted into the space B formed between the spring board 40 and the hair retainer 30 as shown in FIG. 5. Then, the hair retainer 30 is rotated toward its closed position. In this state, as shown in FIG. 6, the hairs will be retained firmly in spite of the relatively small space B formed between the spring board 40 and the hair retainer 30.

As already detailed above, depending on the volume of the hairs which will be retained by the hair clip, a space A formed between the base plate 10 and the spring board 40 or a space B formed between the spring board 40 and the hair retainer 30 can be selectively used. Therefore, the hair clip according to the present invention can firmly retain hairs in an appropriate state despite the amount of hairs.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A hair clip, comprising:

a base plate having at one end portion a pair of hooking arms;

a hair retainer having one end portion rotatably connected to the other end portion of said base plate;

said hair retainer further having at the other end portion thereof an engaging part releasably latched by said pair of hooking arms;

a spring board having one end portion connected to said one end portion of said hair retainer and the other end portion being a free end;

said spring board being positioned between said base plate and said hair retainer and curved in the opposite direction to the curve of said hair retainer.

2. The hair retainer as recited in claim 1, wherein said spring board is made by longitudinally punching an intermediate portion in the crosswise direction of said hair retainer except for both end portions thereof to protrude from said one end of said hair retainer.

3. The hair retainer as recited in claim 1, wherein said spring board has one end portion protruding from said one end portion of said hair retainer towards said base plate, a middle portion protruding from an end of said one end portion and curved in the opposite direction to a curve of said hair retainer.

4. The hair retainer as recited in claim 1, further comprising an ornamental cover fixed to said base plate.

5. A hair clip, comprising:

a base plate having at one end portion a pair of hooking arms capable of overlapping each other, with each of said hooking arms having a hook protruding from an outer edge at an end of said hooking arm;

an ornamental cover secured to said base plate;

a hair retainer having one end portion rotatably connected to the other end portion of said base plate;

said hair retainer further having at the other end portion thereof an engaging part releasably latched by said pair of hooking arms;

a spring board having one end portion protruding from said one end portion of said hair retainer towards said base plate, a middle portion curved in the opposite direction to a curve of said hair retainer and other end portion being a free end;

said spring board being positioned between said base plate and said hair retainer, and being made by longitudinally punching an intermediate portion in the crosswise direction of said hair retainer except for both end portions thereof to protrude from said one end portion of said hair retainer.

6. The hair retainer as recited in claim 1, wherein each hooking arm has a hook protruding from an outer edge at an end of the hooking arm.

7. The hair retainer as recited in claim 1 or 5, wherein the end of each hooking arm is round.

8. The hair retainer as recited in claim 1 or 5, wherein the engaging part comprises a pair of sheet portions which are spaced apart a distance from one another such that the hooking arms are capable of forcibly fitting in between the sheet portions.

* * * * *